US005190167A

United States Patent [19]

Andrews et al.

[11] Patent Number: 5,190,167

[45] Date of Patent: Mar. 2, 1993

[54] ENGINEERING SIZE DOCUMENT STACKER

[75] Inventors: Albert E. Andrews, Rochester; Eugene J. Manno, Ontario, both of N.Y.

[73] Assignee: Xerox Corporation, Stamford, Conn.

[21] Appl. No.: 889,024

[22] Filed: May 26, 1992

[51] Int. Cl.[5] ..... A47F 7/00

[52] U.S. Cl. ..... 211/50; 271/207

[58] Field of Search ..... 211/50, 126; 271/213, 271/207

[56] References Cited

U.S. PATENT DOCUMENTS

| | | | |
|---|---|---|---|
| 3,474,912 | 10/1969 | Pekera et al. | 211/50 |
| 4,220,323 | 9/1980 | Smith | 271/207 X |
| 4,823,963 | 4/1989 | Helmetsie | 211/50 |
| 4,995,602 | 2/1991 | Nakadai et al. | 271/207 |
| 5,037,037 | 8/1991 | Mayer et al. | 211/50 X |
| 5,040,777 | 8/1991 | Bell et al. | 271/3 |
| 5,110,111 | 5/1992 | Gompertz et al. | 271/213 X |
| 5,117,985 | 6/1992 | Bluthardt et al. | 211/181 X |

*Primary Examiner*—Robert W. Gibson, Jr.

[57] ABSTRACT

A low cost document stacking apparatus that passively collects and collates engineering size drawing originals after they have been scanned by use of a catch tray which has two bins. One bin is used to catch "C" and "D" size documents and the other bin catches "E" and larger sized documents. A diverter directs documents to either of the two bins depending on the length of document being scanned.

9 Claims, 3 Drawing Sheets

ENGINEERING SIZE DOCUMENT STACKER

Cross-reference is hereby made to copending, concurrently filed, commonly assigned U.S. application Ser. No. 07/888,582, filed on May 26, 1992, in the name of Daniel L. Moris et al., and entitled COPY OUTPUT STACKER FOR ENGINEERING SIZE COPIES, which Application is incorporated herein by reference. The present invention relates to a copier/printer machine that prints page image information onto copy sheets, and more particularly, to an original document stacker for such a machine.

Heretofore, users of wide format copiers that are capable of copying engineering size drawings would maintain two separate stacks of wide format originals with one of the stacks including originals to be copied and the other stack including originals having already been copied. The user would then manually take originals from the to be copied stack, feed them through the machine, retrieve them from the machine, and place them in the already copied stack. This results in inefficient use of work space and wasted user motion. An improvement over this method of operation is shown in U.S. Pat. No. 4,823,963 in which a rack with two parallel trays is adapted for use with a photocopier. One tray holds originals yet to be copied while the other tray holds originals already copied. The rack fits over and behind the photocopier so as to not require any additional work space. But, this improvement does not address the need to copy multi-document and multi-copy sets. Presently, each document has to be removed from the machine by hand before the next document can be copied.

It is therefore, an object of this invention to provide a document stacking apparatus that allows a user to copy multi-set documents of various sizes in a continuous mode until the set is completed without user involvement.

Therefore, the present invention provides a document stacking apparatus that passively collects and collates engineering drawing originals immediately after being scanned. This is done by using a document catch tray and gate arrangement which is comprised of two bins with leaning slots (one for "C" and "D" sizes and the other for "E" and greater sizes) and a diverter gate which when manually adjusted will direct the sheets in their respective slots.

Figure 1:
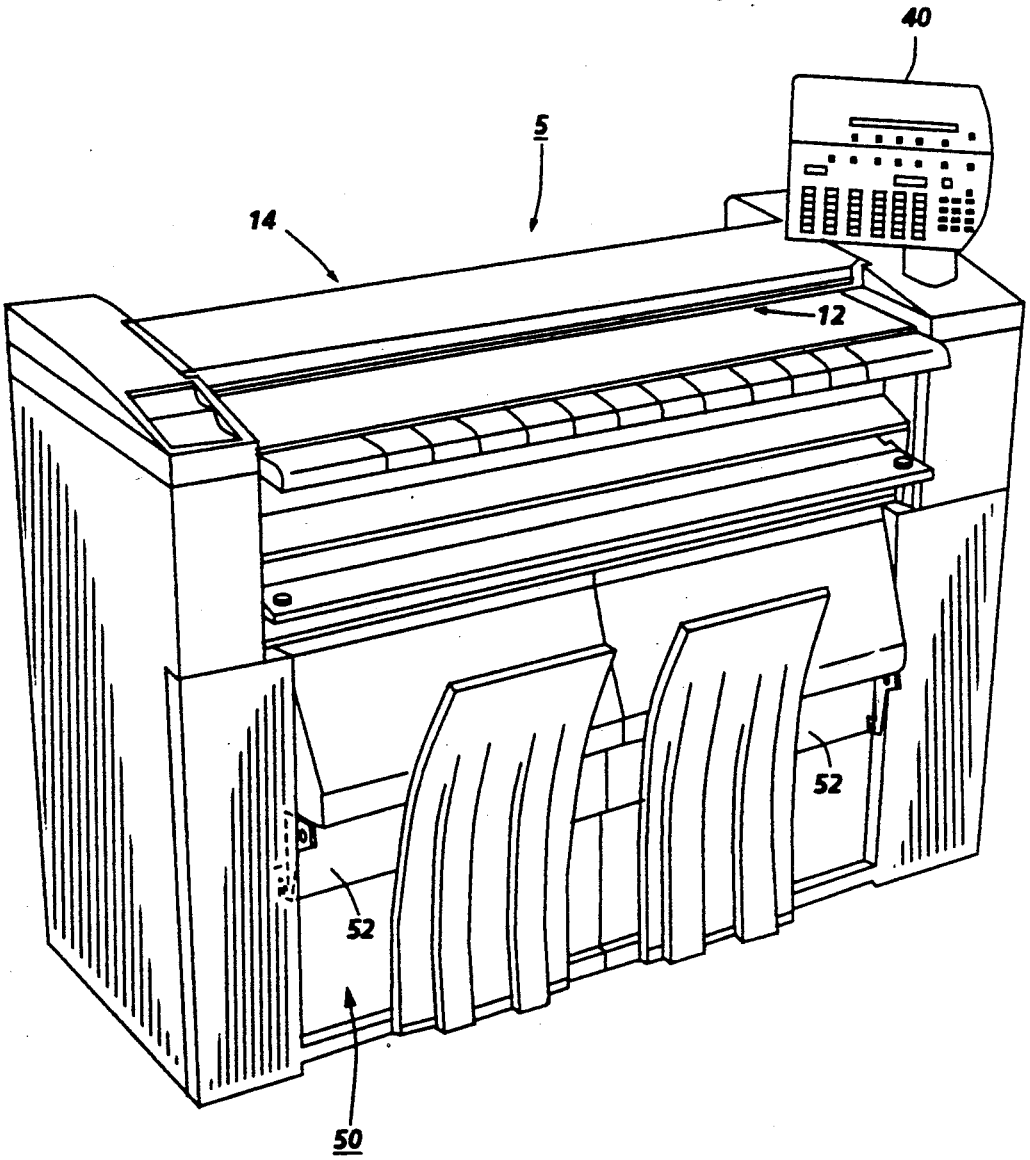
FIG. 1 is a schematic side view of a copier/printer to which the document catch tray of the present invention attached thereto.
Figure 2:
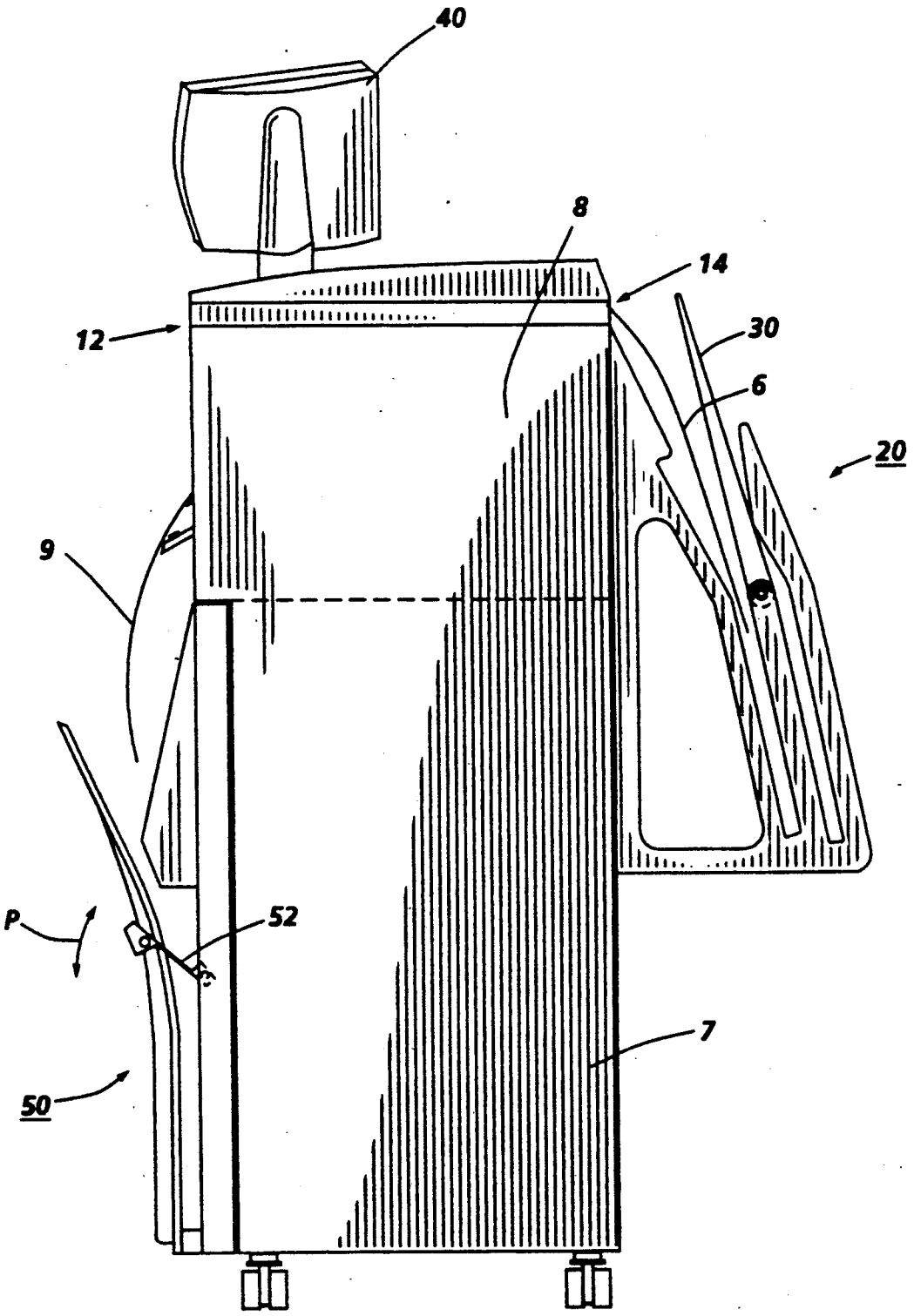
FIG. 2 is an enlarged, partial schematic side view showing the document catch tray of the present invention attached to the copier/printer of FIG. 1.
Figure 3:
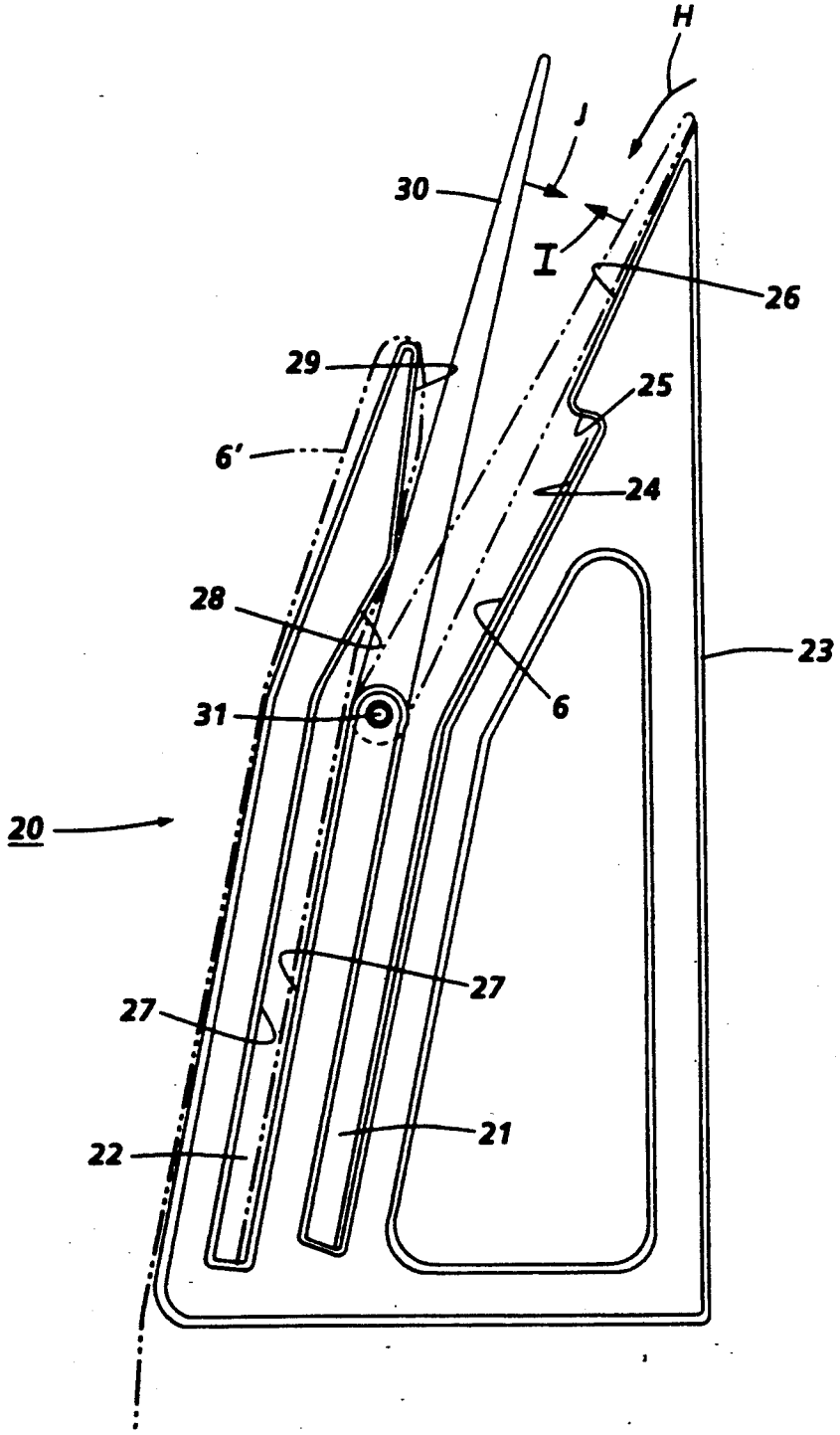
FIG. 3 is an enlarged side view of the document catch tray of the present invention.

Referring now to the drawings in detail, and wherein like numbers indicate like elements, document catch tray 20 in FIG. 2 is shown attached to the back of a copier/printer 5, of the type shown, for example, in U.S. Pat. No. 5,040,777 which is incorporated herein by reference. The copier/printer 5 includes housing 8 that incorporates the machine's xerographic section and a copy sheet supply section 7. Copier/printer 5 also includes document entrance 12 and exit 14 which includes conventional means for driving the documents into document catch tray 20. Catch tray 20 in FIGS. 2 and 3 comprises an upstanding wall 23 that is parallel and attached by suitable means, such as screws or clamps, to a vertical wall of the machine and positioned to receive documents as they are propelled through exit 14. The document catch tray has slots leading to two bins 21 and 22 bounded by side walls and end members that are adapted to support either single or multiple documents with bin 21 configured to receive "C" and "D" size documents and bin 22 configured to receive "E" and larger size documents. Bin 21 has an inner wall 24 which includes multiple slopes extending at different acute angles with respect to vertical wall 23 with one of the slopes coinciding with an orthogonal member 25 that defines an upper end stop or rest for "C" size documents. Documents that are "D" size rest against sloped wall portion 26. Bin 22 is defined by integral sloped wall portions 27, 28 and 29. Inner and outer wall portions 27 are parallel to each other and include a bottom portion that serves as a stop for documents "E" size and larger entering the bin while outer wall portions 28 and 29 are configured at different acute angles with respect to vertical wall 23 to help facilitate the bending of documents over the top of wall portion 29 for convenient stacking.

Copy sheets 9 exiting the xerographic section of machine 5 fall into a catch tray 50. A baffle 52 that pivots between two positions as indicated by arrow P is shown in its copy sheet stopping position in order to stop smaller size copy sheets. The baffle is pivoted to an out of the way position if large copy sheets are entering the catch tray.

A diverter 30 is rotatably mounted on shaft 31 and located in a predetermined position between the outer wall of bin 21 and the inner wall of bin 22 and is adapted to rotate into either of two positions depending on the size of document the user chooses. In its first position as shown in solid lines in FIG. 2, diverter 30 deflects documents exiting the machine in the direction of arrow "H" into bin 21 and when in the dotted line second position serves as a lead in ramp for documents deflected by gravity into bin 22. Diverter 30 is manually set depending upon the size of document the user is feeding into the machine through entrance 12. However, it should be understood that positioning of the diverter could be made automatic through conventional programming of controls actuated by pushing a button on console 40.

In operation of catch tray 20, the user when feeding originals that are "C" and "D" size moves diverter 30 in the direction of arrow "I" to its open position. Individual documents 6 from a multiple document set are fed individually into entrance 12 of the machine and as each document traveling in the direction of arrow "H" exits the machine through exit 14, it contacts the inner surface of diverter 30 and is directed into bin 21. This sequence is repeated until copying of the multiple document set is completed. The document set is automatically collated in bin 21 and is removed from the bin and refed through the machine for the number of times as required to reproduce the copy sheet sets desired. When copying "E" size documents or larger, diverter 30 is moved in the direction of arrow "J" so that each document leaving exit 14 will fall down to the top surface of diverter 30 due to gravity and slide along that surface to the bottom of bin 22. As each document reaches the bottom it continues to be driven out of exit 14 by the machine. This continued driving of each document causes the trail edge of each document shown in phantom as 6' in FIG. 3 to flip due to gravity over the upper edge of bin 22 and hang down adjacent the outer surface of catch tray 20. Thus, the catch tray 20 allows the user to copy multi-set documents of various sizes in a continuous mode until the set is completed while simultaneously retrieving the documents and stacking the individual documents into a set.

It should now be understood that a low cost document stacker apparatus has been shown and described which when mounted to the back of an engineering drawing printer will passively collect and collate engineering drawing originals immediately after being scanned. To accomplish this, a uniquely configured catch tray and gate arrangement is employed and is comprised of two slanted bins with one of the bins being used to catch "C" and "D" sized documents and the other bin to catch "E" and larger sized documents. A diverter is manually adjusted to direct documents into either of the two bins depending upon the size of document that is to be reproduced.

This invention has been described in detail with particular reference to a preferred embodiment thereof, but it will be understood that variations and modifications can be effected within the spirit and scope of the invention and all such variations and modifications are intended to be covered by the appended claims.

What is claimed is:

1. A document stacking catch tray for stacking documents exiting a wide format machine, comprising:

at least two bins configured to hold documents therein; and a diverter which when placed in a first position deflects incoming documents into a first of said at least two bins and when placed in a second position serves as a document support and means for directing incoming documents into a second of said at least two bins.

2. The document stacking catch tray of claim 1, wherein said second of said at least two bins is adapted to allow trail edges of documents to flip over a top portion of said second of said at least two bins and extend downward parallel to an outer surface of said catch tray.

3. The document stacking catch tray of claim 2, wherein said first of said at least two bins includes one wall with multiple portions thereof extending at different acute angles with respect to a vertical plane, and wherein one of said multiple portions of said one wall terminates at an orthogonal end member and serves as a resting location for "C" size documents.

4. A copier for making copies of page image information of original documents fed individually into the copier including a document stacking catch tray for catching and stacking the originals as they exit the copier, comprising:

at least two bins configured to hold documents therein; and a diverter which when placed in a first position deflects incoming documents into a first of said at least two bins and when placed in a second position serves as a document support and means for directing incoming documents into a second of said at least two bins.

5. The document stacking catch tray of claim 4, wherein said second of said at least two bins is adapted to allow trail edges of documents to flip over a top portion of said second of said at least two bins and extend downward parallel to an outer surface of said catch tray.

6. The document stacking catch tray of claim 5, wherein said first of said at least two bins includes one wall with multiple portions thereof extending at different acute angles with respect to a vertical plane, and wherein one of said multiple portions of said one wall terminates at an orthogonal end member and serves as a resting location for "C" size documents.

7. A printer for making copies of scanned documents fed thereinto and including a document stacking catch tray for stacking documents exiting the printer, comprising:

at least two bins configured to hold documents therein; and a diverter which when placed in a first position deflects incoming documents into a first of said at least two bins and when placed in a second position serves as a document support and means for directing incoming documents into a second of said at least two bins.

8. The document stacking catch tray of claim 7, wherein said second of said at least two bins is adapted to allow trail edges of documents to flip over a top portion of said second of said at least two bins and extend downward parallel to an outer surface of said catch tray.

9. The document stacking catch tray of claim 8, wherein said first of said at least two bins includes one wall with multiple portions thereof extending at different acute angles with respect to a vertical plane, and wherein one of said multiple portions of said one wall terminates at an orthogonal end member and serves as a resting location for "C" size documents.

* * * * *